US010974282B2

(12) United States Patent
Wojciechowski et al.

(10) Patent No.: US 10,974,282 B2
(45) **Date of Patent: *Apr. 13, 2021**

(54) METHOD AND APPARATUSES FOR SCREENING

(71) Applicant: Derrick Corporation, Buffalo, NY (US)

(72) Inventors: Keith Wojciechowski, Lakeview, NY (US); Christian Newman, Lakeview, NY (US)

(73) Assignee: DERRICK CORPORATION, Buffalo, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/956,140

(22) Filed: Apr. 18, 2018

(65) Prior Publication Data

US 2018/0236492 A1 Aug. 23, 2018

Related U.S. Application Data

(63) Continuation of application No. 14/882,211, filed on Oct. 13, 2015, now Pat. No. 9,956,591, which is a continuation of application No. 13/653,014, filed on Oct. 16, 2012, now Pat. No. 9,199,279, which is a continuation of application No. 12/460,200, filed on Jul. 15, 2009, now Pat. No. 8,443,984, which is a continuation-in-part of application No. 11/726,589, filed on Mar. 21, 2007, now Pat. No. 7,578,394.

(51) Int. Cl.

| | |
|---|---|
| ***B07B 1/48*** | (2006.01) |
| ***B07B 1/28*** | (2006.01) |
| ***B07B 1/46*** | (2006.01) |
| ***B07B 1/49*** | (2006.01) |

(52) U.S. Cl.

CPC ..... *B07B 1/485* (2013.01); *B07B 1/28* (2013.01); *B07B 1/4609* (2013.01); *B07B 1/4618* (2013.01); *B07B 1/4672* (2013.01); *B07B 1/48* (2013.01); *B07B 1/49* (2013.01)

(58) Field of Classification Search

CPC .. B07B 1/28; B07B 1/48; B07B 1/485; B07B 1/49; B07B 1/4612; B07B 1/4609

USPC ..... 209/276

See application file for complete search history.

(56) References Cited

U.S. PATENT DOCUMENTS

| | | | |
|---|---|---|---|
| 2,311,813 | A | 2/1943 | Beck et al. |
| 5,551,575 | A | 9/1996 | Leone |
| 6,050,423 | A | 4/2000 | Dunnuck et al. |
| 6,267,246 | B1 | 7/2001 | Russell et al. |

(Continued)

FOREIGN PATENT DOCUMENTS

| | | | |
|---|---|---|---|
| DE | 1206372 | B | 12/1965 |
| DE | 2924571 | A1 | 1/1981 |

(Continued)

*Primary Examiner* — Terrell H Matthews

(74) *Attorney, Agent, or Firm* — Jason P. Mueller; FisherBroyles, LLP

(57) ABSTRACT

A screening machine includes wall members, screen assembly guide members, a screen assembly and a compression assembly. The screen assembly includes a frame with a plurality of side members and a screen supported by the frame. The compression assembly is attached to at least one wall member and forms the screen assembly into a concave shape.

25 Claims, 18 Drawing Sheets

(56) References Cited

U.S. PATENT DOCUMENTS

| | | | | |
|---|---|---|---|---|
| 7,578,394 | B2 * | 8/2009 | Wojciechowski | B07B 1/4645 209/364 |
| 7,581,647 | B2 | 9/2009 | Grichar et al. | |
| 9,956,591 | B2 * | 5/2018 | Wojciechowski | B07B 1/485 |
| 2002/0195377 | A1 | 12/2002 | Trench et al. | |
| 2004/0245155 | A1 | 12/2004 | Strong et al. | |
| 2006/0243643 | A1 | 11/2006 | Scott et al. | |
| 2008/0078706 | A1 | 4/2008 | Cady | |
| 2008/0093268 | A1 | 4/2008 | Hukki et al. | |
| 2008/0095980 | A1 | 4/2008 | Hukki et al. | |
| 2010/0307962 | A1 * | 12/2010 | Robertson | B07B 1/46 209/405 |
| 2014/0054216 | A1 | 2/2014 | Burnett | |
| 2015/0197827 | A1 * | 7/2015 | Perkins | C22B 11/04 210/785 |
| 2016/0175888 | A1 * | 6/2016 | Newman | B07B 1/46 209/404 |
| 2019/0321858 | A1 * | 10/2019 | Colgrove | B07B 1/48 |

FOREIGN PATENT DOCUMENTS

| | | | |
|---|---|---|---|
| DE | 19828027 | A1 | 12/1999 |
| GB | 1037102 | A | 7/1966 |
| WO | 0236237 | A1 | 5/2002 |
| WO | 2008014552 | A1 | 2/2008 |
| WO | 2008115673 | A1 | 9/2008 |
| ZA | 200407319 | A | 6/2005 |

* cited by examiner

TOP VIEW 255
256
252
BOTTOM VIEW 256
256
256
255
256
252

274
270
272
W/ UNDULATING SCREEN 264
260
262
W/ FLAT SCREEN

METHOD AND APPARATUSES FOR SCREENING

CROSS-REFERENCE TO RELATED APPLICATIONS

This application is a continuation of U.S. patent application Ser. No. 14/882,211, filed Oct. 13, 2015, which is a continuation of U.S. patent application Ser. No. 13/653,014, filed Oct. 16, 2012, now U.S. Pat. No. 9,199,279, which is a continuation of U.S. patent application Ser. No. 12/460,200, filed Jul. 15, 2009, now U.S. Pat. No. 8,443,984, which is a continuation-in-part of U.S. patent application Ser. No. 11/726,589, filed Mar. 21, 2007, now U.S. Pat. No. 7,578,394, all of which are expressly incorporated herein in their entirety by reference hereto.

FIELD OF THE INVENTION

The present invention relates generally to material screening. More particularly, the present invention relates to a method and apparatuses for screening.

BACKGROUND INFORMATION

Material screening includes the use of vibratory screening machines. Vibratory screening machines provide the capability to excite an installed screen such that materials placed upon the screen may be separated to a desired level. Oversized materials are separated from undersized materials. Over time, screens wear and require replacement. As such, screens are designed to be replaceable.

Vibratory screening machines and their replaceable screens have several drawbacks that limit their productivity and use. In vibratory screening machines, the material to be separated is placed on flat or corrugated replaceable screens. The replaceable screens are tensioned over a surface of the vibratory screening machine such that the replaceable screen tightly fits on the machine. A tensioning arrangement is provided with the machine and is used to provide a tensioning force on the screen. Several techniques are used to tension screens on vibratory screening machines. One technique includes the use of special attachment hooks that grip the sides of the screen and pull it onto a surface of the machine. Replaceable screens have a substantially planar screen area and material often builds up at the screen edges causing maintenance and contamination problems.

SUMMARY

In an example embodiment of the present invention, a vibratory screening machine is provided that simplifies the process of securing a replaceable screen to the machine. The vibratory screening machine and replaceable screen prevent materials to be separated from flowing over the sides of the screen. The replaceable screen is designed to be cost effective and can be quickly installed on the vibratory screening machine.

According to an example embodiment of the present invention, a vibratory screen machine includes: wall members, a concave support surface, a central member attached to the support surface, a screen assembly, a compression assembly and an acceleration arrangement. The screen assembly includes a frame having a plurality of side members and a screen supported by the frame. The screen includes a semi-rigid support place and a woven mesh material on a surface of the support plat. The compression assembly is attached to an exterior surface of a wall member. The compression assembly includes a retractable member that advances and contracts. The acceleration arrangement is configured to impart an acceleration to the screen. As the retractable member advances it pushes the frame against the central member forming the screen assembly into a concave shape against the concave mating surface. The top surface of the screen assembly forms a concave screening surface.

According to an example embodiment of the present invention, a vibratory screen machine includes: a screen assembly; and a compression assembly. The compression assembly deforms a top surface of the screen assembly into a concave shape.

The screen assembly may include a frame having a plurality of side members and a screen supported by the frame. At least one side member may be at least one of a tube member, a formed box member and a formed flange.

The vibratory screen machine may include an acceleration or vibration compression assembly may be attached to at least one wall member and may be positioned on an exterior of a wall member.

The vibratory screen machine may include an acceleration or vibration arrangement configured to impart an acceleration to the screen assembly. The vibratory screen machine may include a support surface wherein the screen assembly forms a concave shape against the support surface.

The vibratory screen machine may include a central member. The screen assemblies may be arranged between the central member and wall members. The central member may be attached to the support surface. The central member may include at least one angled surface configured to urge the screen assembly into a concave shape in accordance with the deformation of the screen assembly by the compression assembly. A side member may be in contact with the central member and another side member may be in contact with the compression assembly.

The vibratory screen may include at least one additional screen assembly having a second frame having a plurality of second side members and a second screen supported by the second frame. A second side member of the additional screen assembly may be in contact with the central member and a side member of the screen assembly may be in contact with the compression assembly. The top surfaced of the at least two screen assemblies may be formed into a concave shape.

The vibratory screen machine may include a second compression assembly and a second screen assembly including a plurality of second side members. A second side member may be in contact with the central member and another second side member may be in contact with the second compression assembly.

The vibratory screen machine may include a mating surface configured to contact the screen assembly. The mating surface may include at least one of rubber, aluminum and steel. The mating surface may be a concave surface. The at least one compression assembly may include a pre-compressed spring that is configured to assert a force against the screen assembly. The pre-compressed spring may assert a force against at least one side of the frame. The compression assembly may include a mechanism, configured to adjust the amount of deflection imparted to the screen assembly. The amount of deflection imparted to the screen may be adjusted by a user selectable force calibration.

The compression assembly may include a retractable member that advances and contracts. The retractable member may advance and contract by at least one of a manual force, a hydraulic force and a pneumatic force. The vibratory screen machine may include at least one additional compression assembly. The compression assemblies may be configured to provide a force in the same direction.

According to an example embodiment of the present invention, a screen assembly for a vibratory screen machine includes: a frame including a plurality of side members and a screen supported by the frame. The screen assembly may be configured to form a predetermined concave shape when placed in the vibratory screening machine and subjected to a compression force by a compression assembly of the vibratory screening machine against at least one side member of the screen assembly. The predetermined concave shape may be determined by a surface of the vibratory screening machine.

At least two side members may be at least one of tube members, box members and formed flanges.

The screen assembly may include a mating surface configured to interact with a surface of the vibratory screening machine. The mating surface may include at least one of rubber, aluminum and steel.

The screen may include a woven mesh material and the frame may include formed flanges on at least two sides.

The frame may include a perforated semi-rigid support plate and the screen may include a woven mesh material. The woven mesh material may be attached to the support plate by at least one of gluing, welding and mechanical fastening.

The screen may include at least two layers of woven mesh material. The frame may include a semi-rigid perforated support plate and the screen may include at least two layers of a woven mesh material in an undulating shape. The at least two layers of a woven mesh material may be attached to the support plate by at least one of gluing, welding and mechanical fastening.

The plate may include a semi-rigid perforated support plate and the screen may include at least three layers of a woven mesh material in an undulating shape. The at least three layers of woven mesh material may be attached to the support plate by at least one of gluing, welding and mechanical fastening.

According to an example embodiment of the present invention, a method for screening materials includes: attaching a screen assembly to a vibratory screen machine and forming a top screening surface of the screen assembly into a concave shape. The method may also include accelerating the screen assembly. The method may also include returning the screen assembly to and original shape, replacing the screen assembly with another screen assembly and performing the attaching and forming steps on another screen assembly. According to an example embodiment of the present invention a vibratory screen machine, includes: a wall member; a guide assembly attached to the wall member and having at least one mating surface; a concave support surface; a central member; a screen assembly including a frame having a plurality of side members and a screen supported by the frame, the screen including a semi rigid support plate and a woven mesh material on a surface of the support plate, a portion of the screen assembly forming a screen assembly mating surface configured to mate with the at least one mating surface of the guide assembly; a compression assembly attached to an exterior surface of the wall member, the compression assembly including a retractable member that advances and contracts; and an acceleration arrangement configured to impart an acceleration to the screen assembly, wherein as the retractable member advances it pushes the frame against the central member forming the screen assembly into a concave shape against the concave mating surface, the top surface of the screen assembly forming a concave screening surface.

According to an example embodiment of the present invention a vibratory screen machine includes: a wall member; a guide assembly attached to the wall member and having at least one mating surface; a screen assembly having a screen assembly mating surface configured to mate with the at least one mating surface of the guide assembly; and a compression assembly, wherein the compression assembly deforms a top surface of the screen assembly into a concave shape.

According to an example embodiment of the present invention a screen assembly for a vibratory screening machine includes: a frame including a plurality of side members and having a mating surface; and a screen supported by the frame, wherein the screen assembly is configured to form a predetermined concave shape when subjected to a compression force by a compression assembly of the vibratory screening machine against at least one side member of the screen assembly when placed in the vibratory screening machine, wherein the screen assembly mating surface is configured to interface with a mating surface of the vibratory screening machine such that the screen is guided into a fixed position on the vibratory screening machine.

According to an example embodiment of the present invention a screen assembly for a vibratory screening machine includes: a frame including a pluralityof side members; and a screen supported by the frame, wherein the frame has a convex shape configured to mate with a concave surface of the vibratory screening machine, the frame held in place by a force of a compression assembly of the vibratory screening machine against at least one side member of the screen assembly when placed in the vibratory screening machine.

According to an example embodiment of the present invention a method for screening materials includes: attaching a screen assembly to a vibratory screening machine screening machine using a guide assembly to position the screen assembly in place; and forming a top screening surface of the screen assembly into a concave shape.

DETAILED DESCRIPTION

Figure 1:
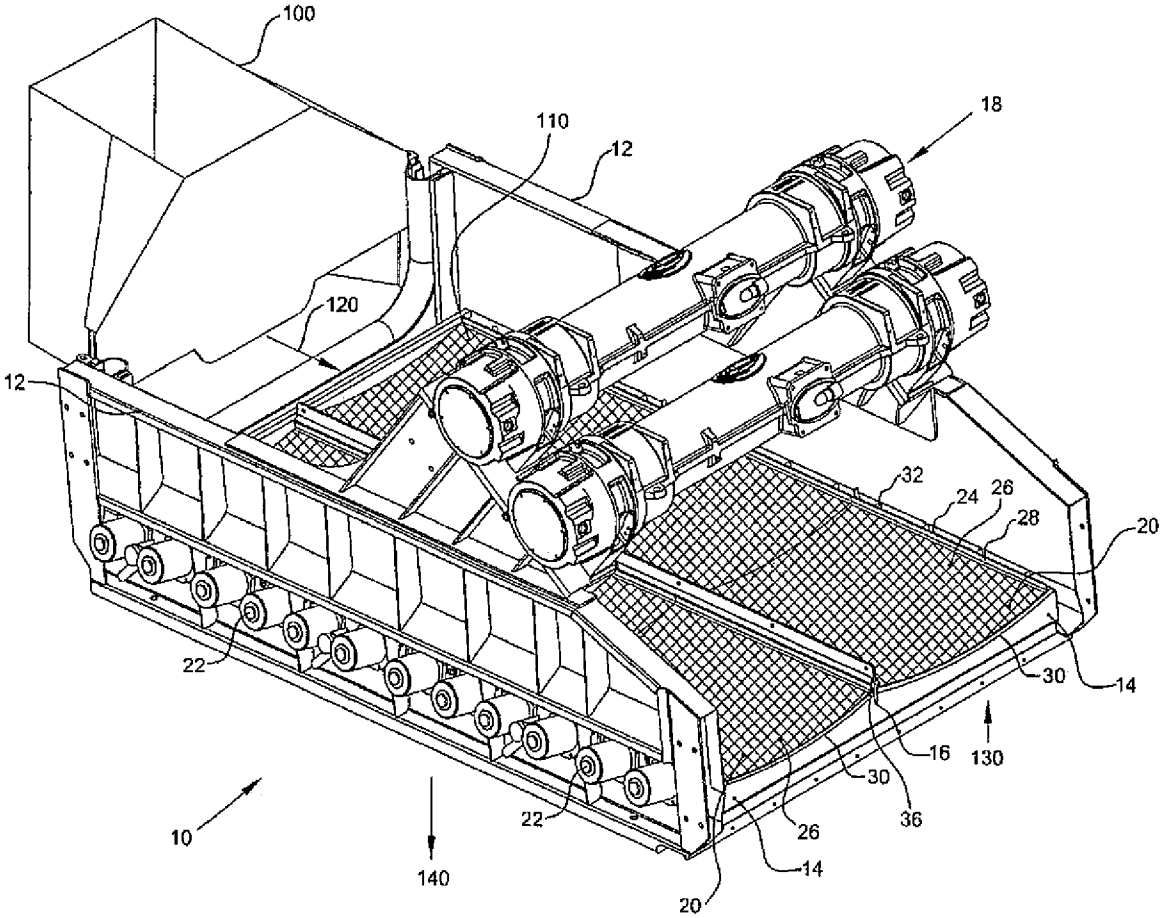
FIG. 1 shows a perspective view of a vibratory screen machine with installed replaceable screens assemblies according to an example embodiment of the present invention.

Like reference characters denote like parts in the drawings.

FIG. 1 shows vibratory screening machine 10 with installed replaceable screening assemblies 20. Material is fed into a feed hopper 100 and is then directed onto a top surface 110 of the screen assemblies 20. The material travels in flow direction 120 toward the vibratory screening machine 10 end 130 the material flowing in direction 120 is contained within the concave configuration provided by the screen assemblies 20. The material is prevented from exiting the sides of screen assemblies 20. Material that is undersized and/or fluid passes through screen assemblies 20 onto a separate discharge material flow path 140 for further processing. Materials that are oversized exit end 130. The material screen may be dry, a slurry, etc. and the screen assemblies 20 may be pitched downwardly from the hopper 100 toward an opposite end in the direction 120 to assist with the feeding of the material.

Vibratory screen machine 10 includes wall members 12, concave support surfaces 14, a central member 16, an acceleration arrangement 18, screen assemblies 20 and compression assemblies 22. Central member 16 divides vibratory screening machine 10 into two concave screening areas. Compression assemblies 22 are attached to an exterior surface of wall members 12. Vibratory screening machines 10 may, however, have one concave screening area with compression assemblies 22 arranged on one wall member. Such an arrangement may be desirable where space is limited and maintenance and operational personnel only have access to one side of the vibratory screening machine. Also, multiple screening areas may be provided. While vibratory screening machine 10 is shown with multiple longitudinally oriented screen assemblies creating to parallel concave material pathways, screen assemblies 20 are not limited to such a configuration and may be otherwise oriented. Additionally, multiple screening assemblies 20 may be provided to form a concave screening surface (see, e.g., FIG. 9).

Screen assemblies 20 include frames 24 and screens 26. Frames 24 include side members 28. Side members 28 are formed as flanges but may be formed of any elongated member such as tubes, formed box members, channels, plates, beams, pipes, etc. Screens 26 may include a semi-rigid perforated support plate 80 and a woven mesh material 82 on a surface 84 of the support plate 80 (see, e.g., FIG. 4). Support plate 80 need not be perforated but may be configured in any manner suitable for the material screening application. The woven mesh material may have two or more layers. The layers of a woven mesh material may be in an undulating shape. The woven mesh material may be attached to the semi-rigid support plate by gluing, welding, mechanical fastening, etc. Screens 26 are supported by frames 24.

As discussed above, compression assemblies 22 are attached to an exterior surface of wall members 12. Compression assemblies 22 include a retractable member 32 (see e.g., FIG. 2) that extends and contracts. Retractable member 32 is a pin, but may be any member configured to exert a compressive force against frame 24 to urge side members 28 toward each other to deform screen assemblies 20 into a concave profile. As set forth below, retractable members 32 advance and contract by a pneumatic and spring forces but may also advance and contract by manual forces, hydraulic forces, etc. Also as set forth below, compression assembly 22 may be configured as pre-compressed springs (see, e.g., FIGS. 6 to 8).

Compression assemblies 22 may also be provided in other configurations suitable for providing a force against screen assemblies 20. As shown in FIG. 1, compressions assemblies 22 include retractable members 32, which are illustrated in FIG. 1 in an extended position asserting a force against frames 24. Frames 24 are pushed against central member 16 causing screen assemblies 20 to form a concave shape against support surfaces 14. Central member 16 is attached to support surface 14 and includes angled surfaces 36 (see, e.g., FIGS. 2 and 3) that prevent frames 24 from deflecting upward when they are compressed. Support surfaces 14 have a concave shape and include mating surfaces 30. Support surfaces 14 may, however, have different shapes. Also, central member 16 need not be attached to support surface 14. Additionally, vibratory screening machine 10 may be provided without support surfaces. Screen assemblies may also include mating surfaces that interact with the mating surfaces 30 of support surface 14. The mating surfaces of screen assemblies 20 and/or the mating surfaces 30 may be made of rubber, aluminum, steel or other materials suitable for mating.

Acceleration arrangement 18 is attached to vibratory screening machine 10. Acceleration arrangement 18 includes a vibrator motor that causes screen assemblies 20 to vibrate.

Figure 2:
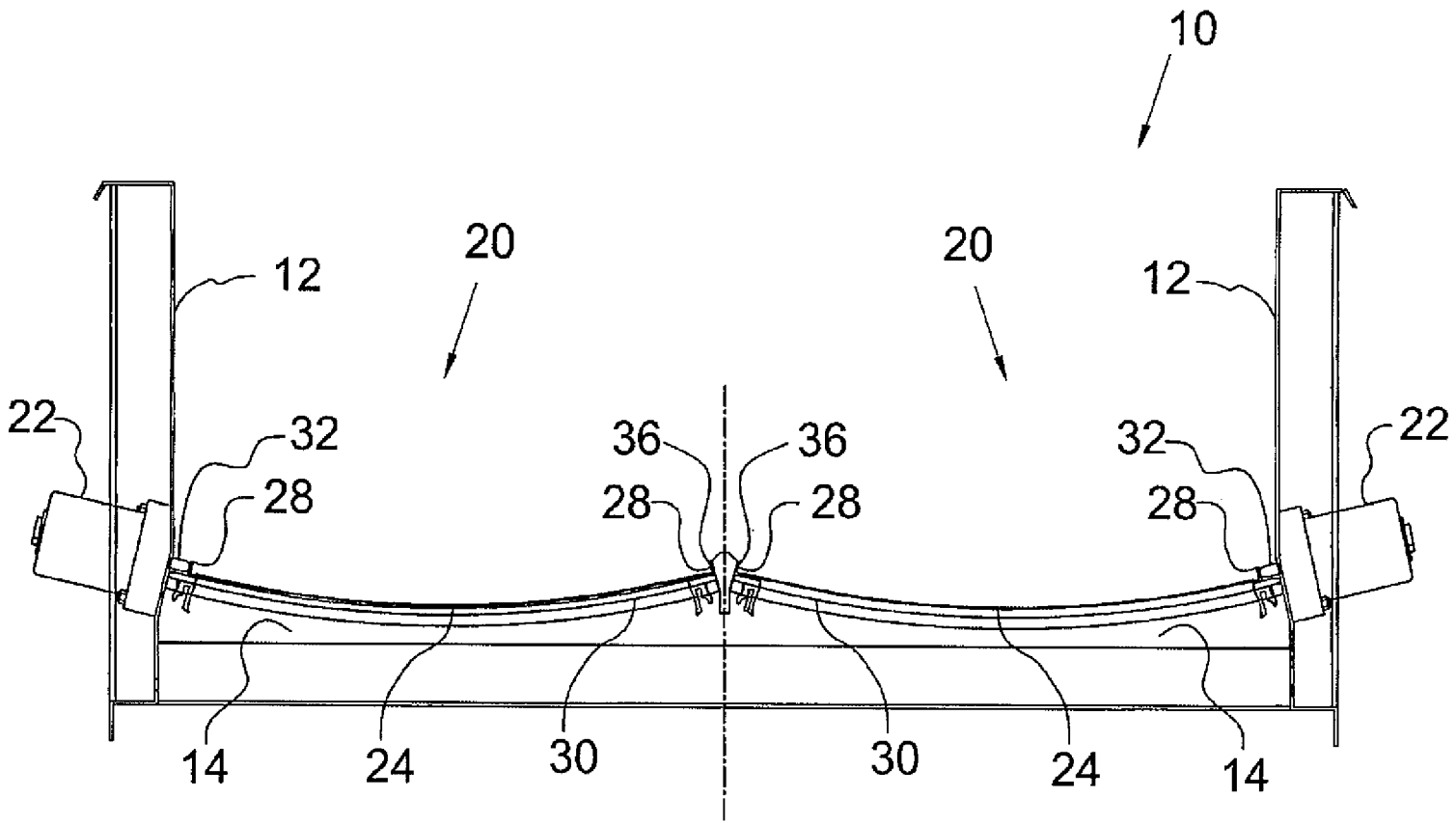
FIG. 2 shows a cross-sectional view of the vibratory screen machine shown in FIG. 1.

FIG. 2 shows the side walls 12, screen assemblies 20, compression assemblies 22 and support members 14 of the vibratory screening machine 10 shown in FIG. 1. Frames 24 of screen assemblies 20 include side members 28. The side members 28 form flanges.

As described above, compression assemblies 22 are mounted to wall members 12. Retractable members 32 are shown holding screen assemblies 20 in a concave shape. Materials to be separated are placed directly on the top surfaces of screen assemblies 20. Also as described above, the bottom surfaces of screen assemblies may include mating surfaces. The bottom surfaces of screen assemblies 20 interact directly with the mating surfaces 30 of concave support surfaces 14 such that screen assemblies 20 are subjected to vibrations form acceleration arrangement 18 via e.g., concave support surfaces 14.

The placement of the top surfaces of screen assemblies 20 into a concave shape provides for the capturing and centering of materials. The centering of the material stream on screen assemblies 20 prevents the materials from exiting the screening surface and potentially contaminating previously segregated materials and/or creating maintenance concerns. For larger material flow volumes, the screen assemblies 20 may be placed in greater compression, thereby increasing the amount of arc in the top surface and bottom surface. The greater the amount of arc in the screen assemblies 20 allows for greater retaining capability of material by the screen assemblies 20 and prevention of over spilling of material off the edges of the screen assemblies 20.

Figure 3:
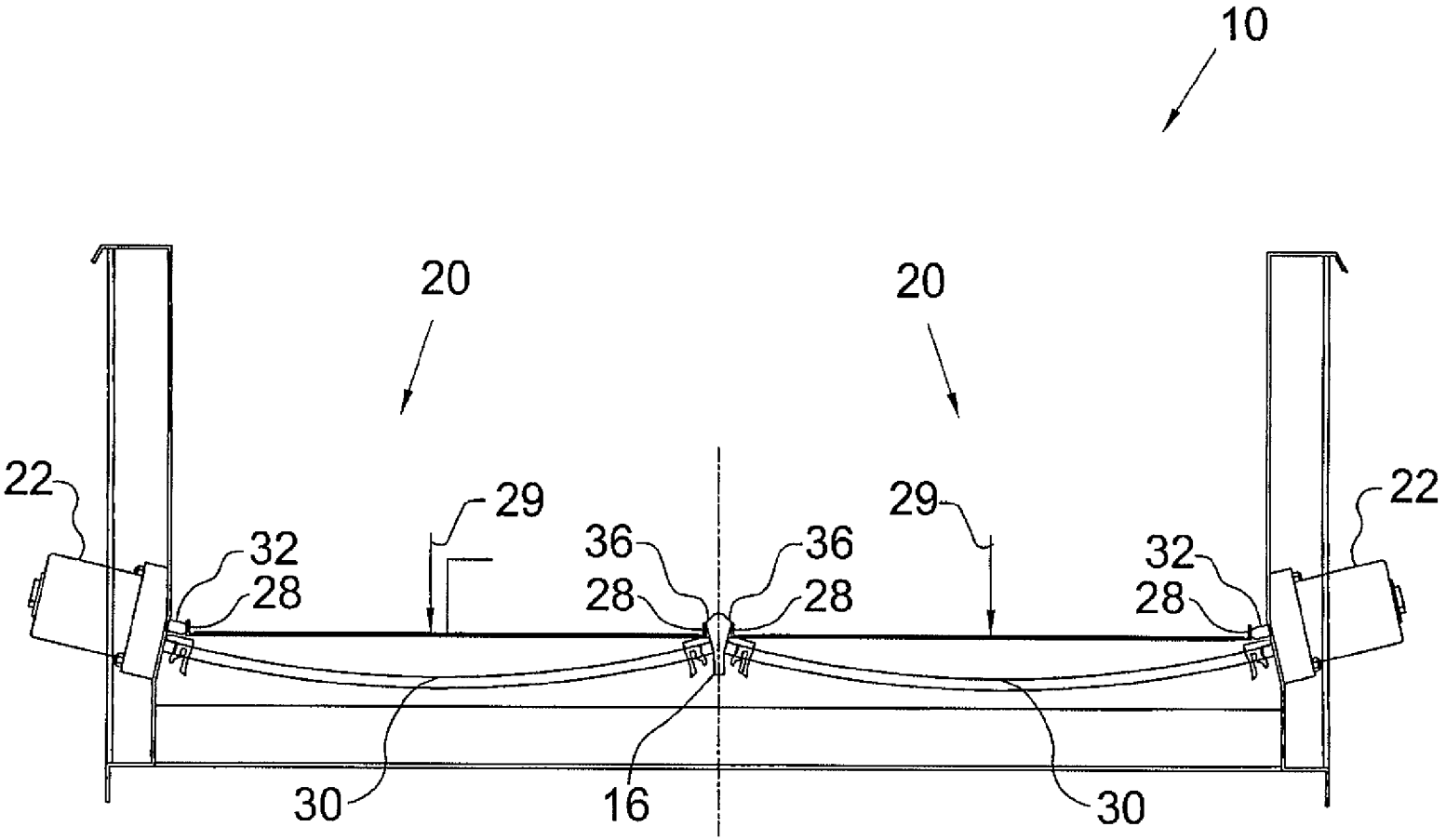
FIG. 3 shows a cross-sectional view of a vibratory screen machine with replaceable screen assemblies prior to final installation.

FIG. 3 shows screen assemblies 20 in an undeformed state. Retractable members 32 are in a retraced position. When retractable members 32 are in the retracted position, screen assemblies 20 may be readily replaced. Screen assemblies 10 are placed in the vibratory screening machine 10 such that side members 28 contact angled surfaces 36 of central member 16. While the replaceable screen assemblies 20 are in the undeformed state, the retractable members 32 are brought into contact with screen assemblies 20. The angled surface 36 prevent side members 28 from deflecting in an upward direction. When compression arrangement 22 is actuated, retractable members 32 extend from the compression assembly 22 causing the overall horizontal distance between the retractable members and angled surfaces 36 to decrease. As the total horizontal distance decreases, the individual screen assemblies 20 deflect in a downward direction 29 contacting supporting surfaces 30 (as shown in FIG. 2). Angled surfaces 36 are also provided so that the screen assemblies 20 are installed in the vibrating screening machine 10 at a proper arc configuration. Different arc configurations may be provided based on the degree of extension of retractable members 32. The extension of retractable members 32 is accomplished through constant spring pressure against the body of compression arrangement 22. The retraction of retractable members 32 is accomplished by mechanical actuation, electro mechanical actuation, pneumatic pressure or hydraulic pressure compressing the contained spring thereby retracting the retractable member 32 into the compression arrangement 22. Other extension and retractions arrangements may be used including arrangements configured for manual operation, etc. (see, e.g., FIGS. 6 to 8). The compression assembly 22 may also include a mechanism for adjusting the amount of deflection imparted to the screen assemblies 20. Additionally, the amount of deflection imparted to the screen assemblies 20 may be adjusted by a user selectable force calibration.

Figure 4:
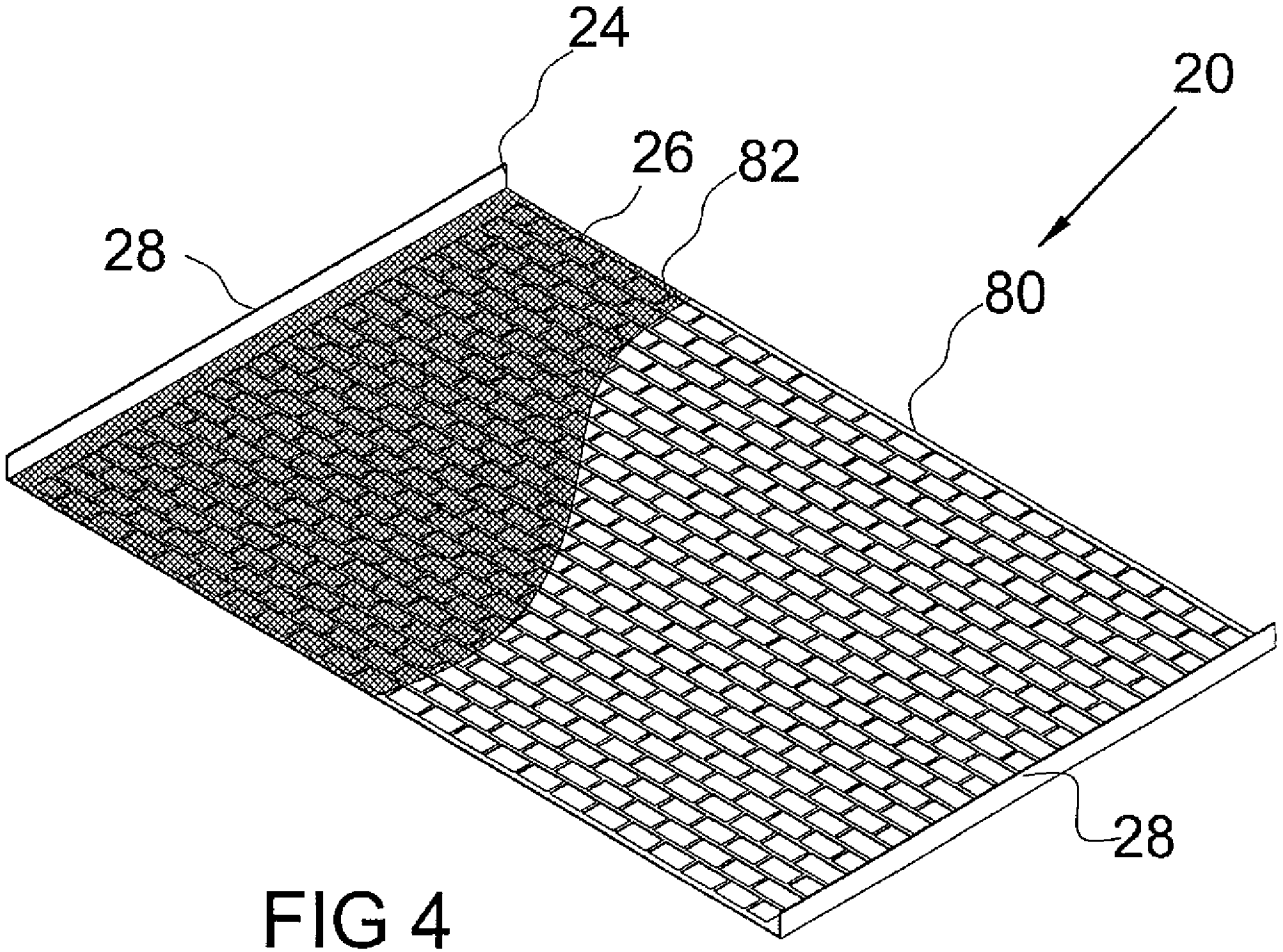
FIG. 4 shows a perspective view of a replaceable screen assembly according to an example embodiment of the present invention.

FIG. 4 shows a replaceable screen assembly 20. Screen assembly 20 includes frame 24 and screen 26. Frame 24 includes side members 28. Frame 24 includes a semi-rigid perforated support plate 80 and screen 26 includes a woven mesh material 82 on a surface of the support plate 80. Screen 26 is supported by frame 24. Screen assembly 20 is configured to form a predetermined concave shape when placed in a vibratory screening machine and subjected to appropriate forces.

Figure 5:
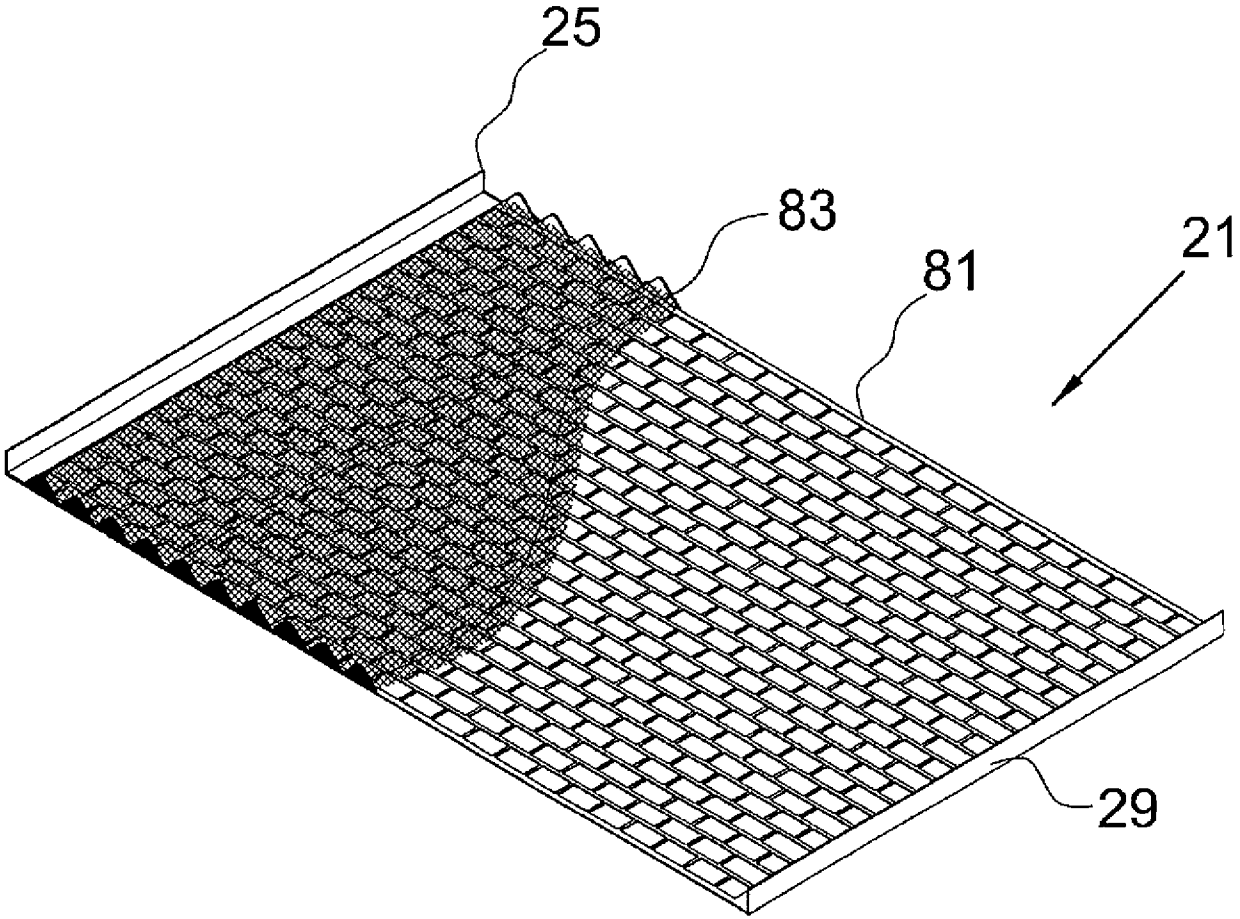
FIG. 5 shows a perspective view of a replaceable screen assembly according to an example embodiment of the present invention.

FIG. 5 shows a replaceable screen assembly 21. Screen assembly 21 includes frame 25 and an undulating screen 27. Frame 25 includes side members 29 and a semi-rigid perforated support plate 81. Undulating screen 27 includes a woven mesh material 83 on a surface of the support plate 81. Undulating screen 27 is supported by frame 25. Screen assembly 21 is configured to form a predetermined concave shape when placed in a vibratory screening machine and subjected to appropriate forces.

Figure 6:
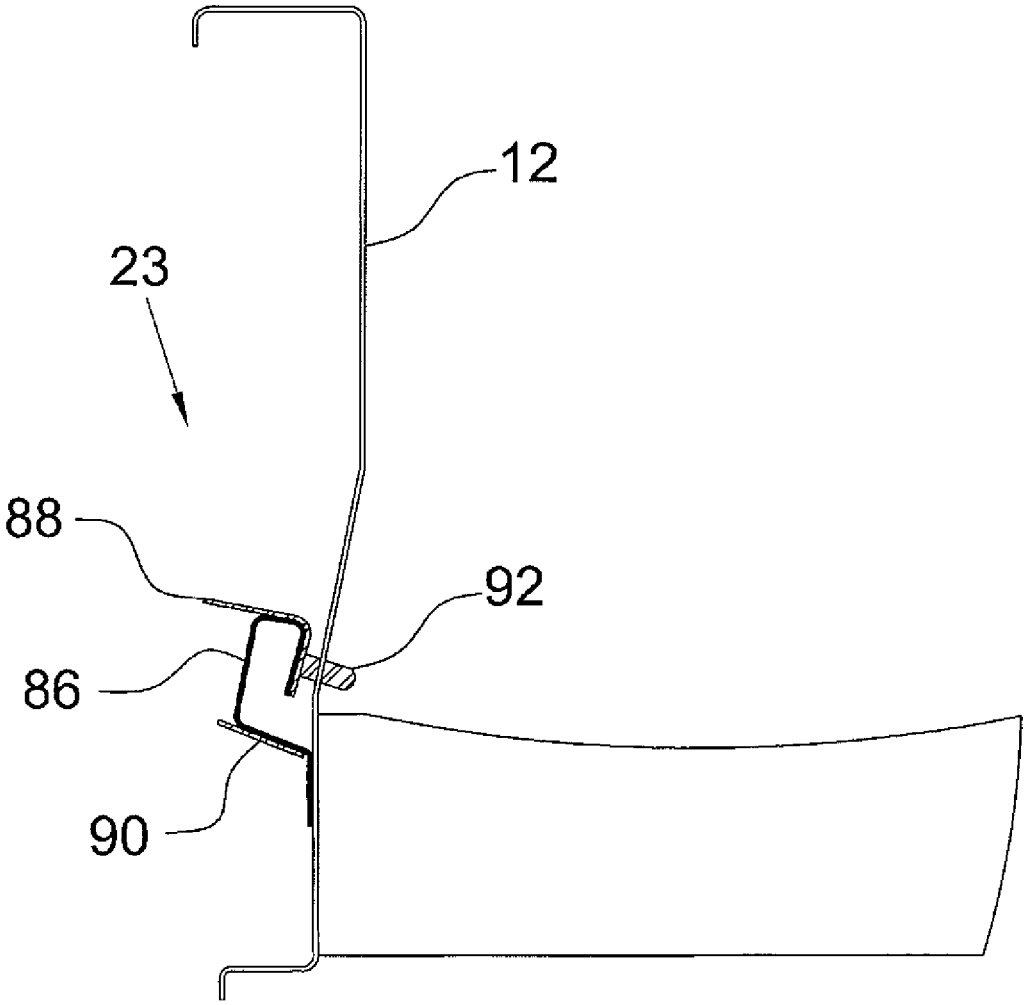
FIG. 6 shows a cross-sectional view of a portion of a vibratory screen machine with a pre-compressed spring compression assembly with a pin in an extended position.
Figure 7:
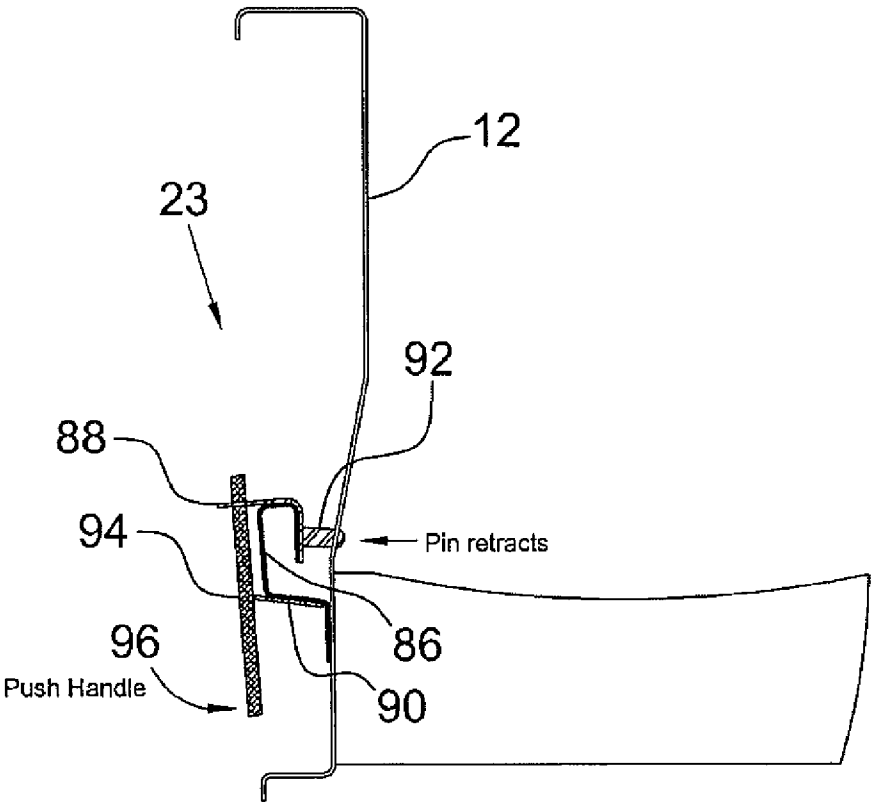
FIG. 7 shows a cross sectional view of the vibratory screen machine shown in FIG. 6 with the pin in a retracted position.
Figure 8:
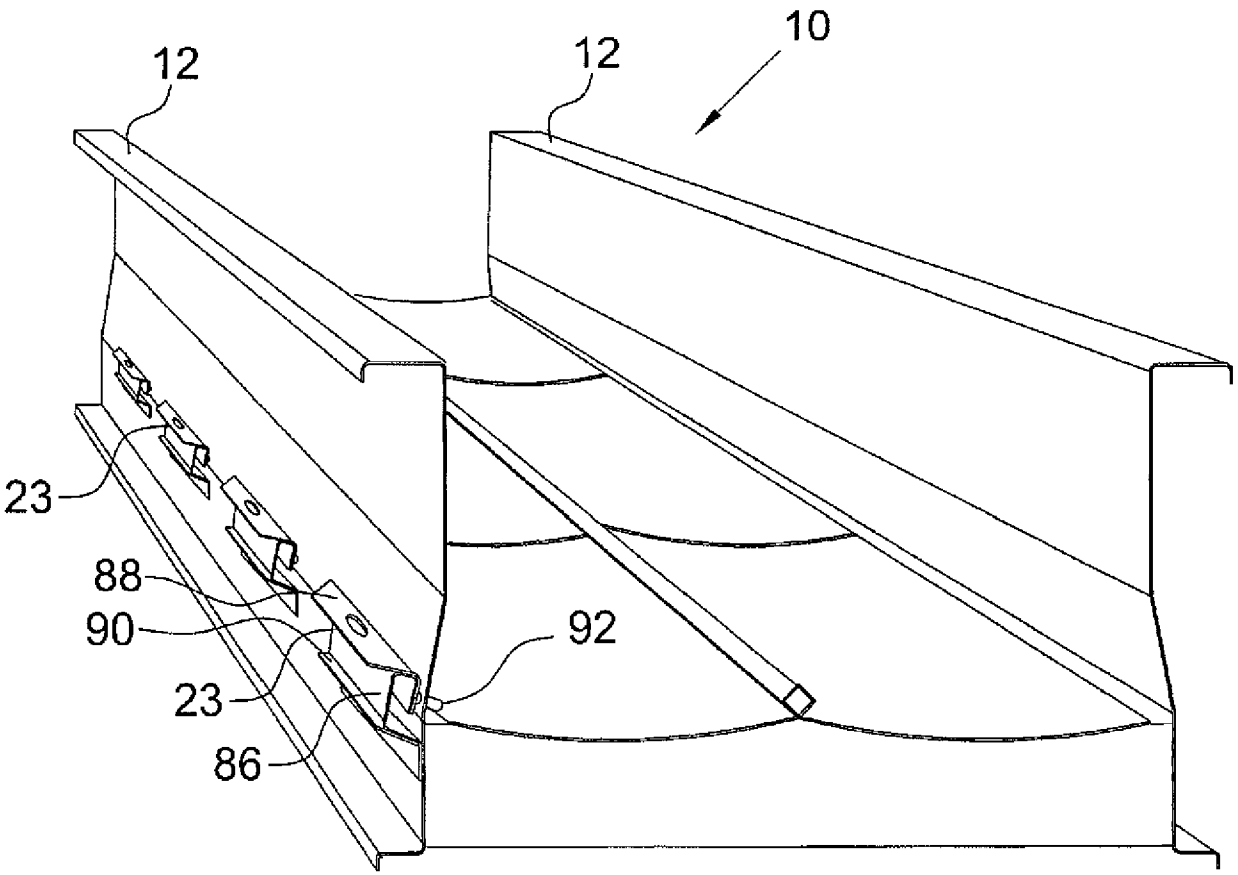
FIG. 8 shows a perspective view of a vibratory screen machine.

FIGS. 6 to 8 show a pre-compressed spring compression assembly 23. Pre-compressed spring compression assembly 23 may be used in pace of or in conjunction with compression assembly 22. Pre-compressed spring compression assembly includes a spring 86, a retractor 88, a fulcrum plate 90 and a pin 92. Pre-compressed spring compression assembly 23 is attached to wall member 12 of vibratory screen machine 10.

In FIG. 6, pre-compressed spring compression assembly 23 is shown with pin 92 in an extended position. In this position, pin 92 asserts a force against a screen assembly such that the screen assembly forms a concave shape.

In FIG. 7, pin 92 is shown in a retracted position. To retract pin 92 a push handle 34 is inserted into an aperture in retractor 88 and pressed against fulcrum plate 90 in direction 96. The force on retractor 88 causes spring 86 to deflect and 92 to retract. A surface may be provided to secure pre-compressed spring compression assembly 23 in the retracted position. Although a simple lever retracting system is shown, alternative arrangements and systems may be utilized.

In FIG. 8, vibratory screen machine is shown with multiple pre-compressed spring compression assemblies 23. Each compression assembly may correspondence to a respective screen assembly 20 so that installation and replacement of screen assembly 20 requires retraction of a single corresponding compression assembly 23. Multiple pins 92 may be provided in each of pre-compressed spring compression assemblies 23. As set forth above, other mechanical compression assemblies may be utilized.

Figure 9:
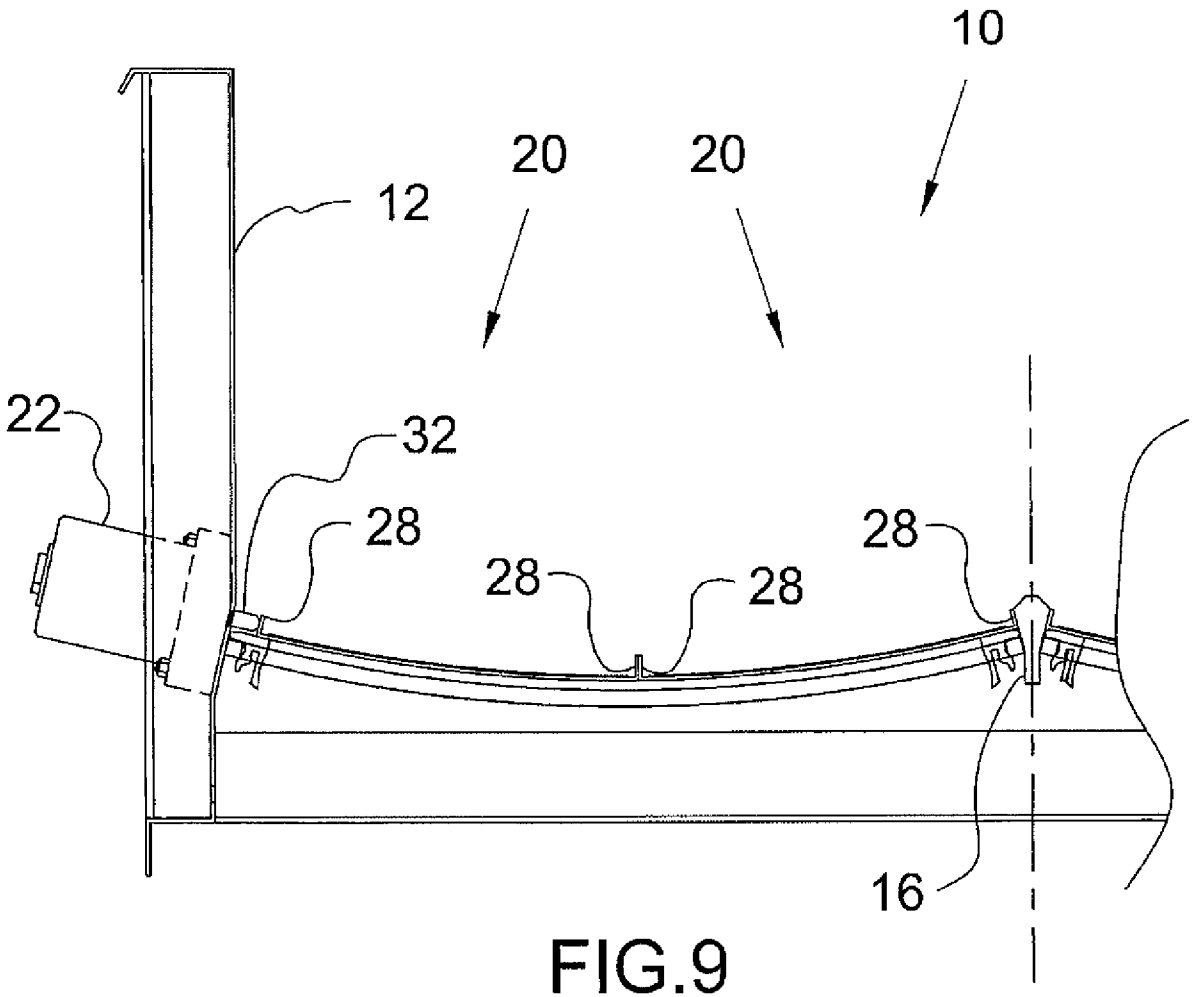
FIG. 9 shows a cross-sectional view of the vibratory screening machine according to an embodiment of the present invention.

FIG. 9 shows vibratory screening machine 10 with multiple screen assemblies 20 forming a concave surface. The first screen assembly 20 has one side member 28 in contact with pin members 32 and another side member 28 in contact with side member 28 of a second screen assembly 20. The second screen assembly 20 has another side member 28 in contact with central member 16. As shown, pin members 32 are in the extended position and screen assembles 20 and formed into a concave shape. The force asserted by pin members 32 cause screen assemblies 20 to push against each other and central member 16. As a result, the screen assemblies deflect into a single concave shape. The side members 28 that are in contact with each other may include brackets or other securing mechanisms configured to secure the screen assemblies 20 together. Although two screen assemblies are shown, multiple screen assemblies may be provided in similar configurations. The use of multiple screen assemblies may provide for reduced weight in handling individual screen assemblies as well as limiting the amount of screening area that needs to be replaced when a screen assembly becomes damaged or worn.

Figure 10:
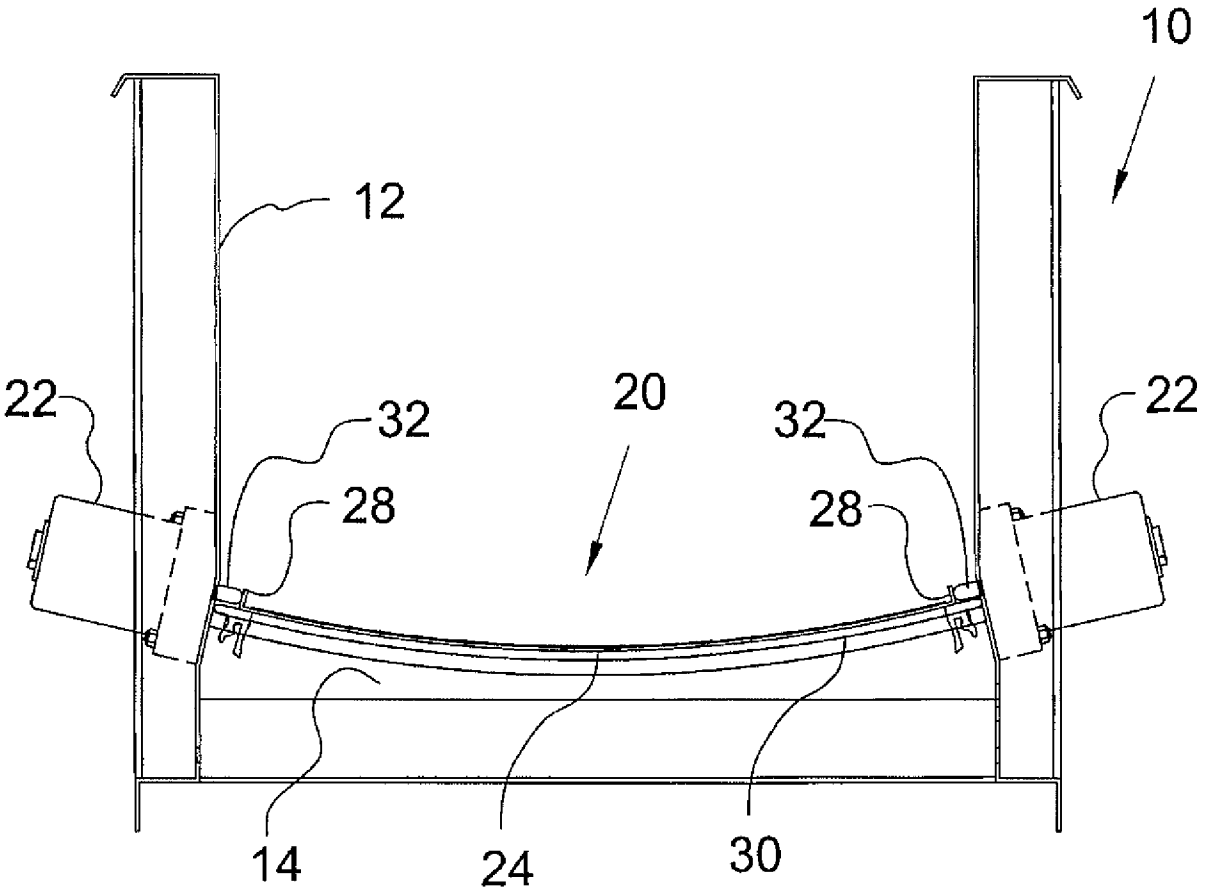
FIG. 10 shows a cross-sectional view of a vibratory screen machine according to an embodiment of the present invention.
Figure 12:
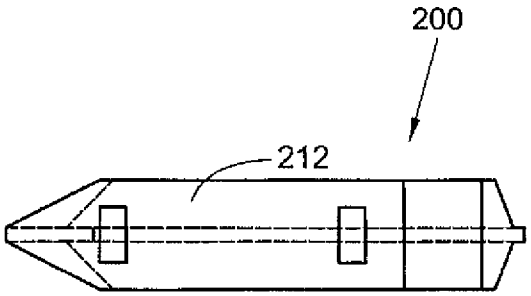
FIG. 12 shows a bottom view of the guide assembly shown in FIG. 11.
Figure 11:
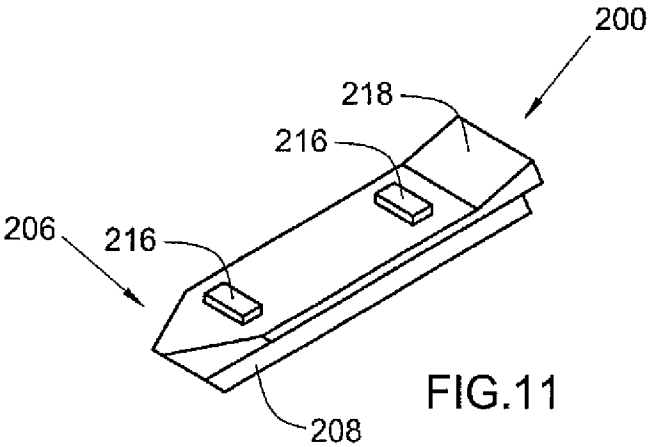
FIG. 11 shows a perspective view of a guide assembly according to an example embodiment of the present invention.
Figure 14:
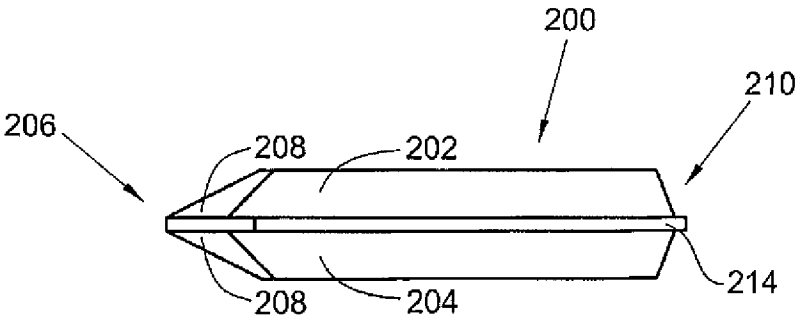
FIG. 14 shows a top view of the guide assembly shown in FIG. 11.

FIG. 10 shows vibratory screen machine 10 without a central member. Vibratory screen machine 10 includes at least two compression assemblies 22 that have retractable members 32 that extend toward each other. Retractable members 32, which are illustrated in the extended position, assert a force against side members 28 of screen assemblies 20 causing screen assemblies 20 to form a concave shape and replacing the screen assembly with another screen assembly.

FIGS. 11 to 14 show a guide assembly 200. Guide assembly 200 may be attached to wall 12 of vibratory screening machine 10 and includes mating surfaces or guide surfaces 202, 204 that are configured to guide replaceable screen assembly 220 into position on vibratory screening machine 10. See, for example, FIG. 19. Guide assembly 200 is configured such that an operator may easily and consistently position or slide replaceable screen assembly 220 into a desired location on vibratory screening machine 10. In guiding screen assembly 220 into position, mating surfaces 202, 204 of guide assembly 200 interface with a corresponding mating surface 240 of screen assembly 220. Guide assemblies 200 prevent screen assembly 220 from moving to unwanted positions and act to easily secure screen assembly 220 into place so that compression assemblies 22, as described herein, may properly act on screen assembly 220. Guide assembly 200 may have any shape suitable for positioning screen assembly 220 into place, including, but not limited to, triangular shapes, circular shapes, square shapes, arched shapes, etc. Likewise, screen assembly 220 may include a portion (see, for example, notch 230 in FIG. 15) with a corresponding shape configured to interface with and/or mate with a corresponding guide assembly.

Figure 13:
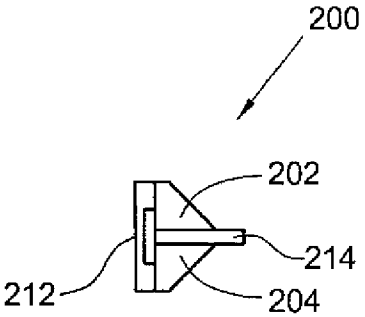
FIG. 13 shows an end view of the guide assembly shown in FIG. 11.

As shown in FIGS. 11 to 14, guide assembly 200 is an elongated member having a first end 206 with angled surfaces 208, a second end 210, a back surface 212, mating surfaces 202, 204 and a central column 214, the back surface 212 may be attached to wall 12 and may include tabs 216 and raised portion 218 to facilitate attachment to wall 12 such that guide assembly 200 is in a generally vertical position with the first end 206 facing up and the second end 210 facing down. See, for example, FIG. 23. As shown in FIGS. 11 to 14, mating surfaces 202, 204 slope towards the central column 214 and meet on side surfaces of central column 214. As can be seen in FIG. 13 central column 214 extends beyond mating surfaces 202 and 204 and may serve to locate and/or separate two separate replaceable screen assemblies, the first screen assembly having a surface that interfaces with mating surface 202 and the second screen assembly having a surface that interfaces with mating surface 204. As shown in this example embodiment, mating surfaces 202, 204 form a generally triangular shape where one of mating surfaces interfaces 202, 204 mates with a mating surface of the screen assembly 220 such that during insertion of the screen assembly 220 into the screening machine 10, the screen assembly 220 is guidable along one of mating surfaces 202, 204 to a fixed position so that the retractable members 32 may push against a frame 228 of screen assembly 220. See FIGS. 15 and 23. Angled surfaces 208 of first end 206 have a generally sloped shape so that the mating surface of screen assembly 220 will not catch and will easily slide onto guide assembly 200. Guide assembly 200 may be attached to wall 12 in any way such that it is secured into a desired position. For example it may be welded into place, secured with an adhesive or have a mechanism such as a tab that locks it into place. Moreover, guide assembly 200 may be configured to be removable from wall 12 so that it can be easily relocated, for example, using tabs and slots, along wall 12 to accommodate multiple or different sized screen assemblies.

Figure 15:
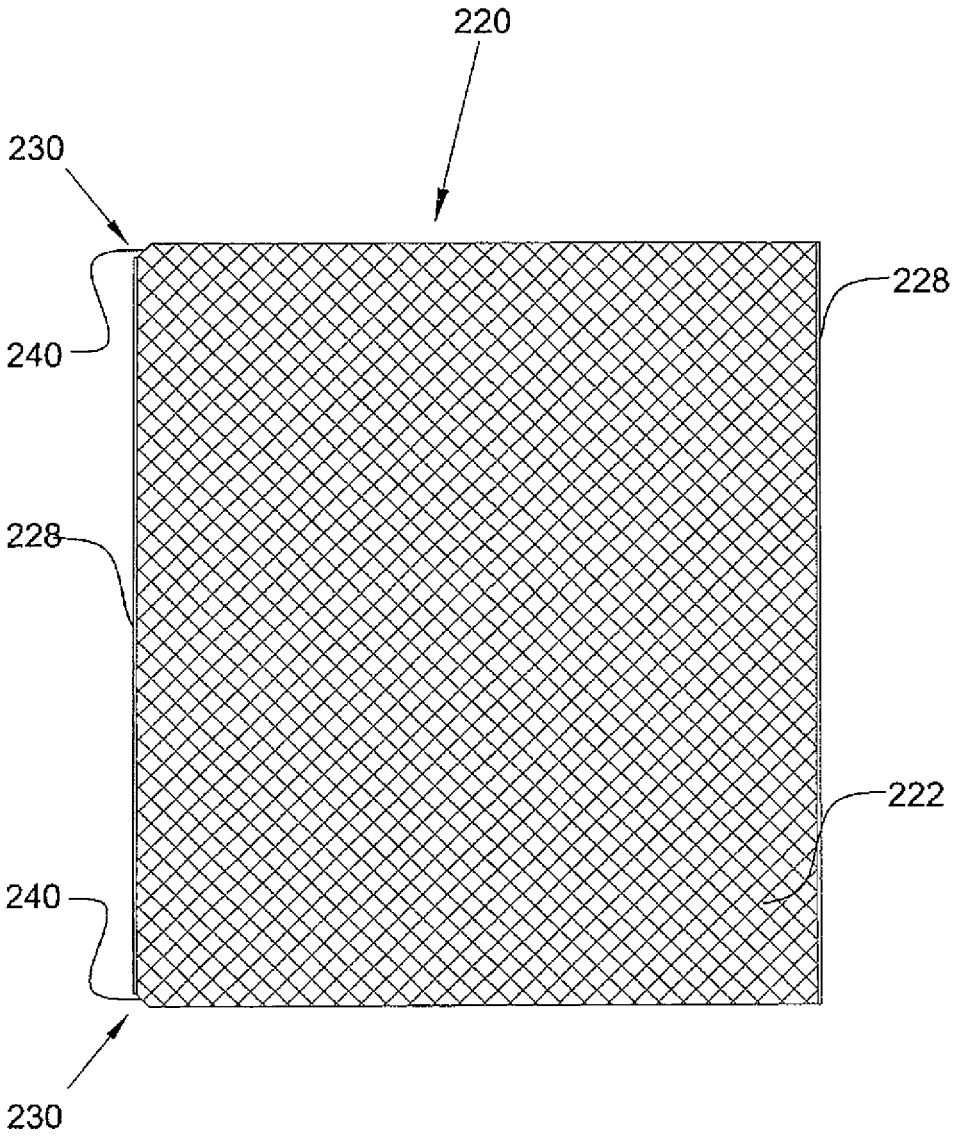
FIG. 15 shows a top view of a replaceable screen assembly according to an example embodiment of the present invention.
Figure 16:
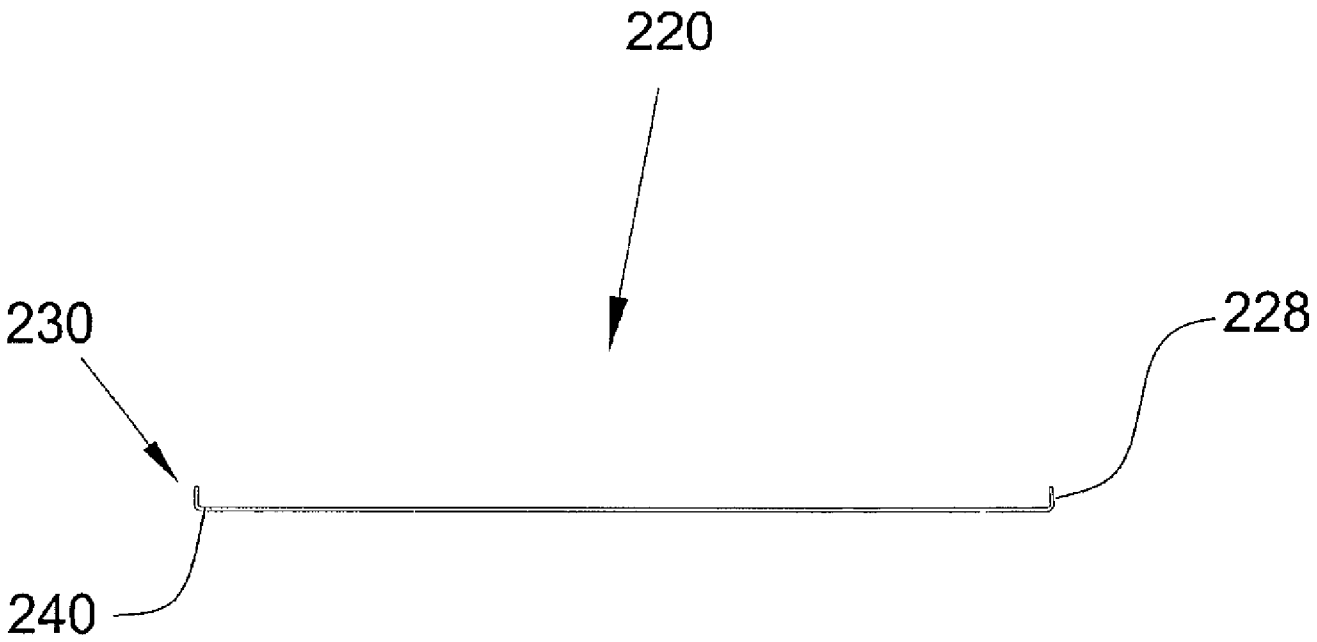
FIG. 16 shows an end view of the screen assembly shown in FIG. 15.

FIGS. 15 to 16 show replaceable screen assembly 220. Replaceable screen assembly 220 includes a frame 228 and screens 222. Screen assembly 220 may be identical or similar to screen assemblies 20 as described herein and include all the features of screen assemblies 20 (frame configurations, screen configurations, etc.) as described herein. Screen assembly 220 includes notches 230 configured to receive guide assembly 200. Notches 230 include mating surfaces 240 that mate with or interface with mating surfaces 202, 204 of guide assembly 200. Although notches 230 are shown as an angular cut out of a corner of screen assembly 220 they may take any shape that receives guide assembly 200 and locates screen assembly 220 into a desired position on screening machine 10. Moreover, mating surfaces 240 may take any shape necessary to guide screen assembly 220 into a desired position.

Figure 17:
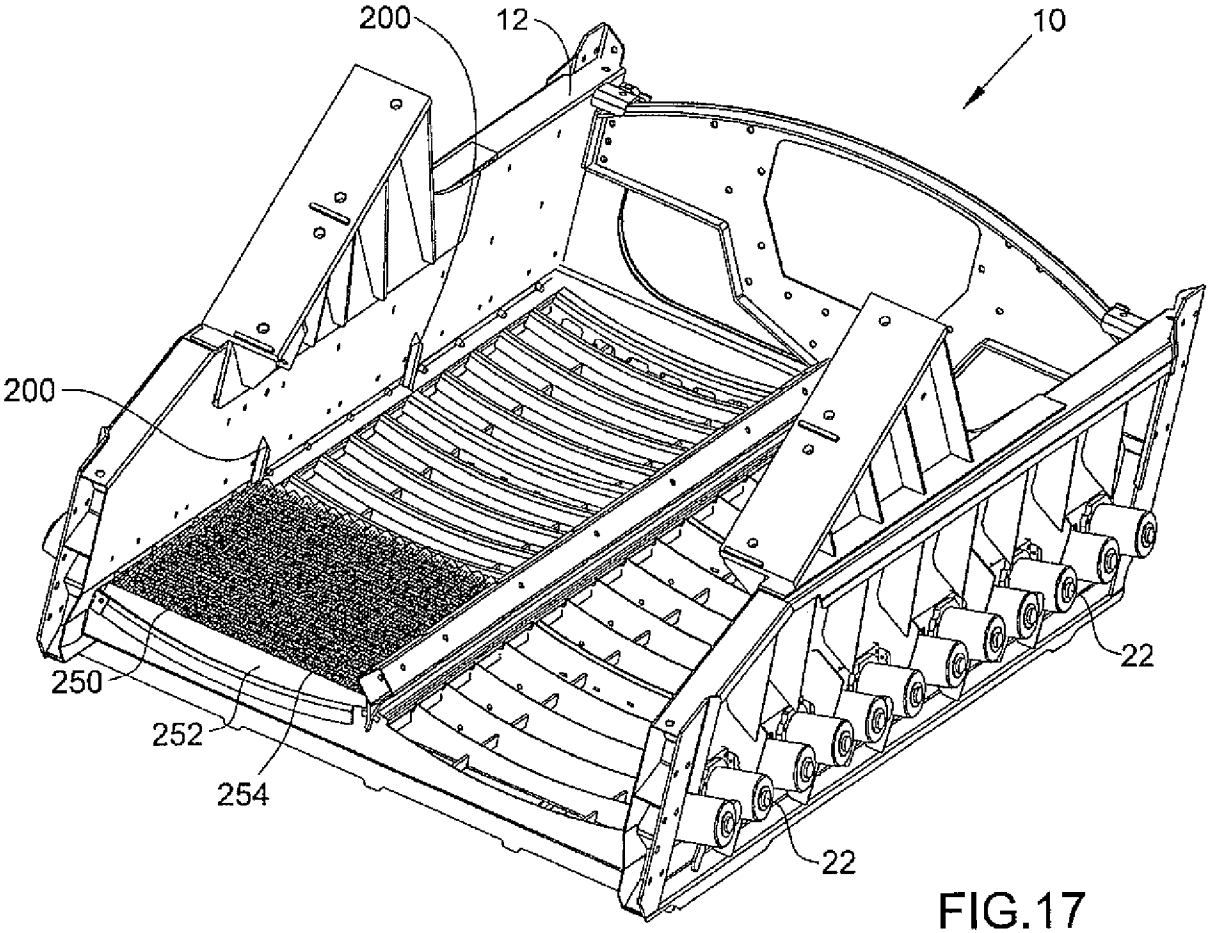
FIG. 17 shows a perspective view of a vibratory screen machine according to an example embodiment of the present invention.

FIG. 17 shows vibratory screen machine 10 with guide assemblies 200 and pretension screen assembly 250. Pretension screen assembly 250 is shown positioned in place by the first guide assembly 200. Pretension screen assembly 250 includes a frame 252 and a screening surface 254. Frame 252 has a convex shape is configured to form fit to the concave bed of screening machine 10 as shown screening surface 254 is flat with an undulating screen. Screening surface 254 may also be preformed into a concave shape. Compression members 22 act to hold pretension screen assembly 250 in place (by pushing it against central member 16) without substantially deforming the top surface of screen assembly 250 into a concave shape. Similar to screen assemblies 220 discussed above, pretension screen assembly 250 includes notches configured to receive guide assembly 200. The notches include mating surfaces that mate with or interface with mating surfaces 202, 204 of guide assembly 200. Although the notches are shown as an angular cut out of a corner of pretension screen assembly 250 they may take any shape that receives guide assembly 200 and locates pretension screen assembly 250 into a desired position on screening machine 10. Moreover, the mating surfaces of the pretension screen assemblies may take any shape necessary to guide pretension screen assembly 250 into a desired position. Multiple guide assemblies and screens may be included with screening machine 10. Pretension screen assembly 250 may also be configured without notches so that it fits a vibratory screening machine that does not have guide assemblies.

Figure 18:
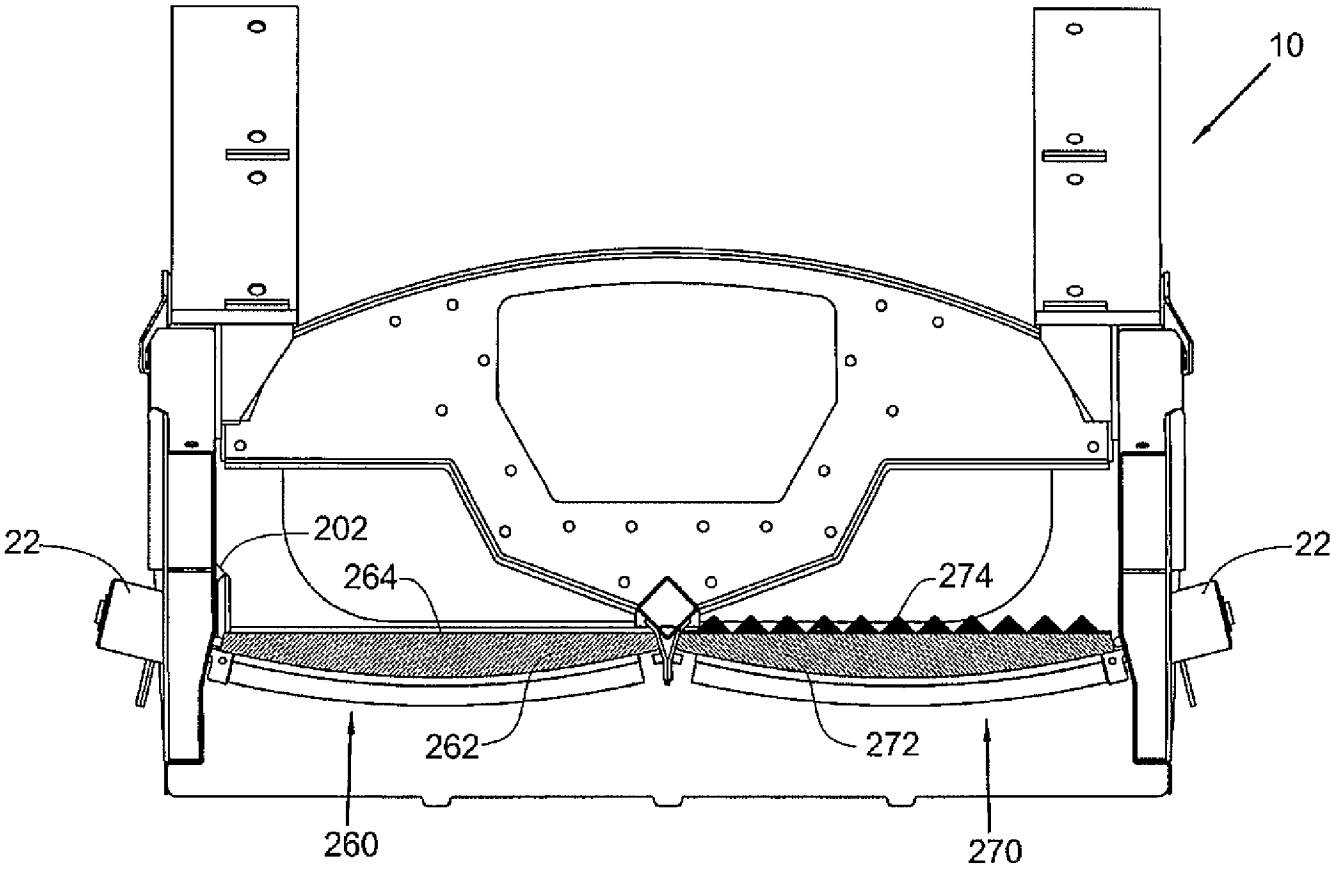
FIG. 18 shows a cross-section view of a vibratory screen machine according to an example embodiment of the present invention.

FIG. 18 shows screening machine 10 with pretension screen assemblies 260, 270. Pretension screen assemblies 260, 270 include the same features as pretension screen assembly 250 as described herein. Screen assembly 260 is shown with frame 262 and flat screening surface 264. Screen assembly 270 is shown with frame 272 and undulating screening surface 274. Pretension screen assemblies 260, 270 may also be configured without notches so that they fit a vibratory screening machine that does not have guide assemblies.

Figures 19, 20, 21, 22:
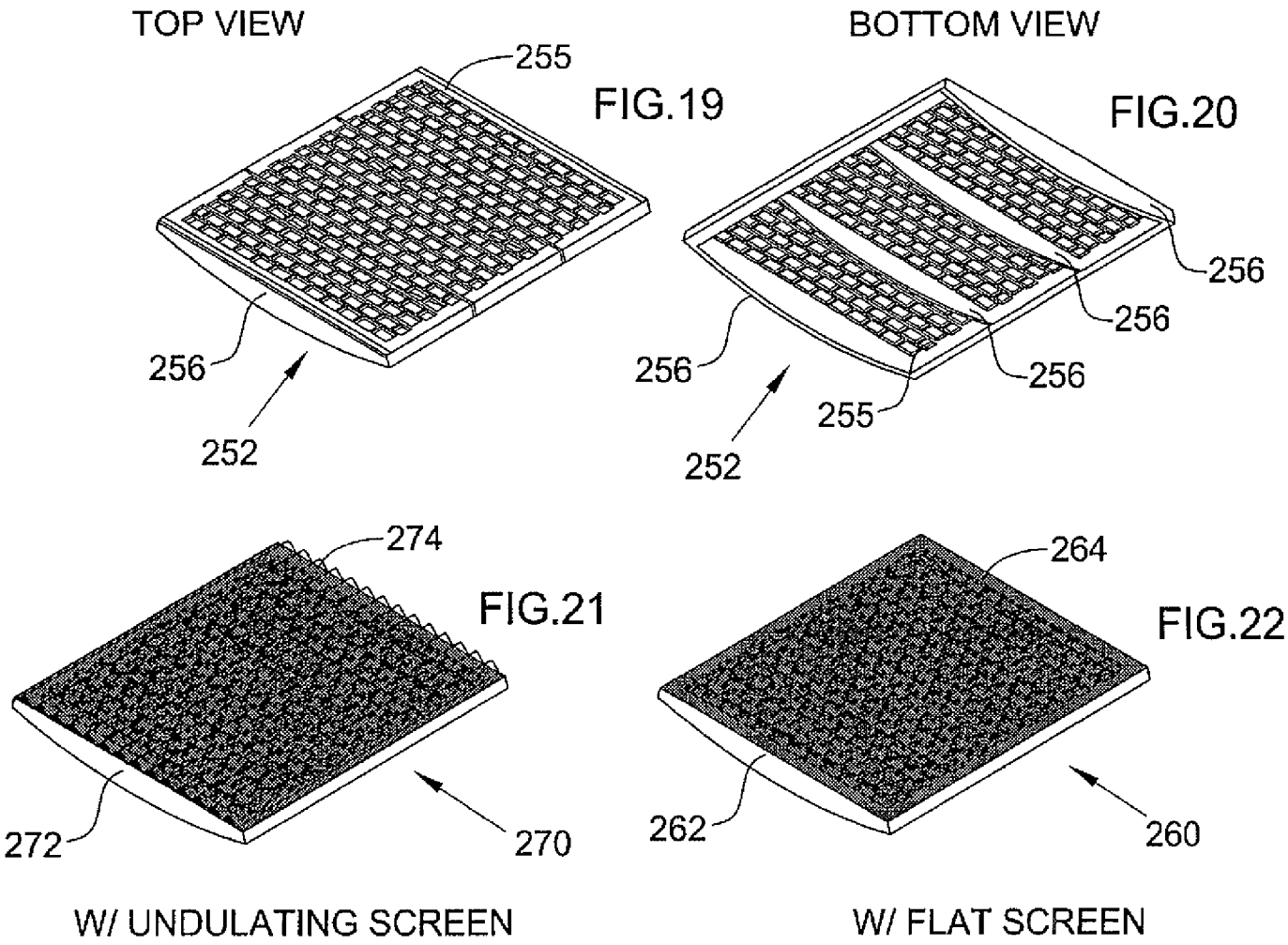
FIGS. 19 and 20 show perspective views of a frame of a pretension screen assembly according to an exemplary embodiment of the present invention.
FIGS. 21 and 22 show perspective views of pretension screen assemblies according to exemplary embodiments of the present invention.

FIGS. 19 and 20 show frame 252 of pretension screen assembly 250. Frame 252 includes screen support surface 255 and cross support members 256 that have convex arches for mating with and being supported by a concave support surface of vibratory screening machine 10.

FIG. 21 shows pretension screen assemblies 270 with flat screen 274 attached to frame 272.

FIG. 22 shows pretension screen assembly 260 with flat screen 264 attached to frame 262.

Figure 23:
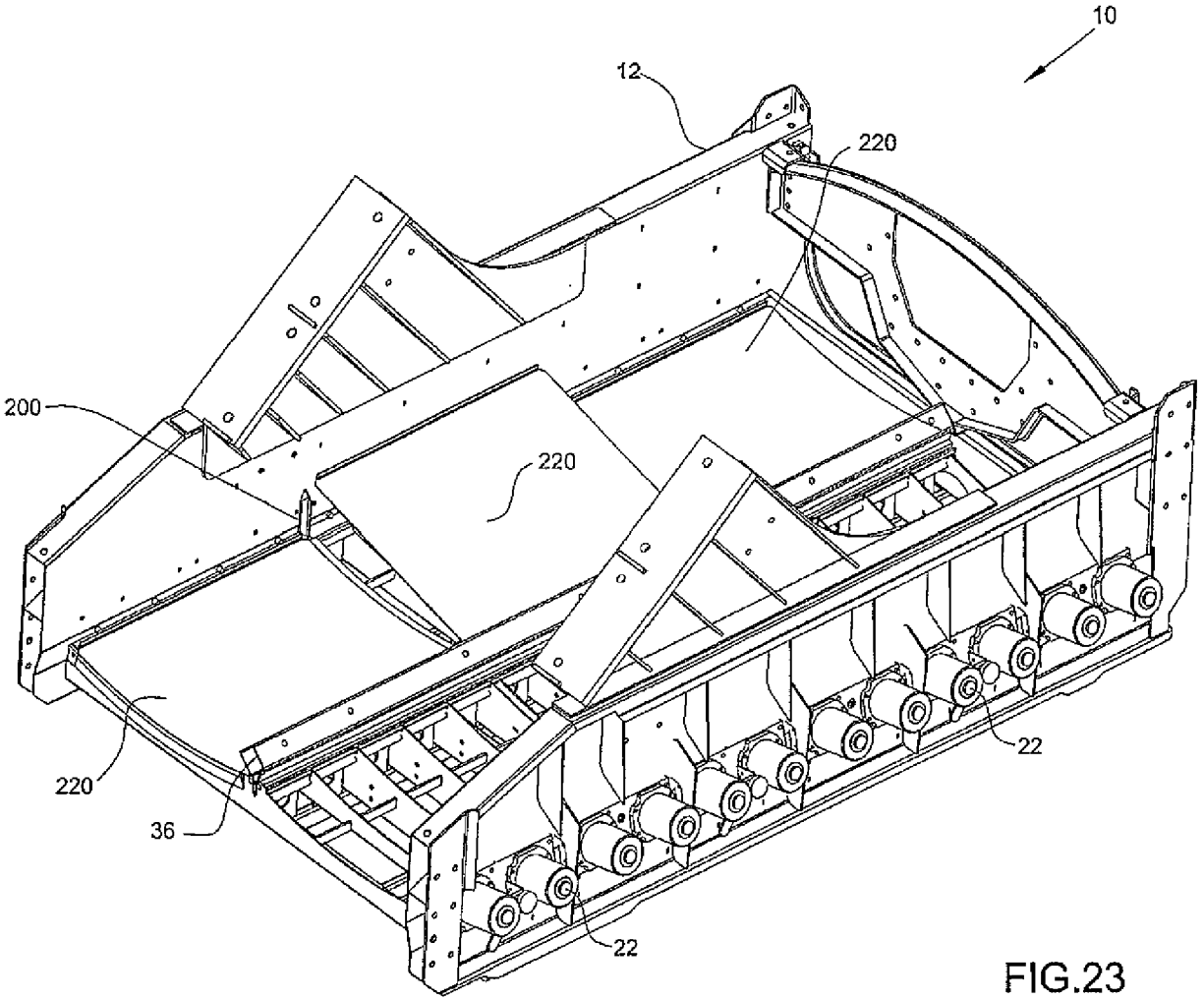
FIG. 23 shows a perspective view of a vibratory screen machine according to an example embodiment of the present invention.

FIG. 23 shows a vibratory screen machine 10 with multiple screen assemblies 220 positioned using guide assemblies 200. As shown, the central screen assembly 220 is positioned on screening machine 10 by first placing an edge of frame 222 against central member 36 and then lowering it into place using guide assemblies 200.

Figure 24:
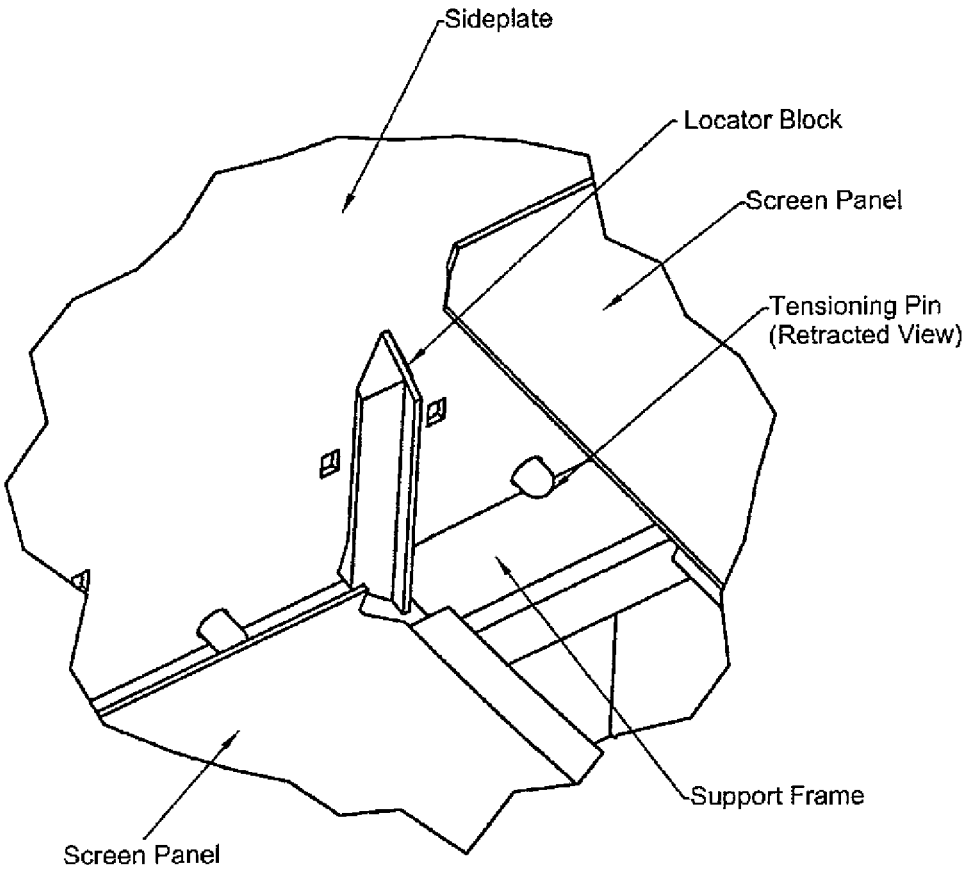
FIG. 24 shows a perspective view of a portion of vibratory screening machine according to an exemplary embodiment of the present invention.

FIG. 24 shows a close-up of a portion of a vibratory screening machine that includes a guide block (or guide assembly) and screen assemblies according to an example embodiment of the present invention.

According to another example embodiment of the present invention a method is provided that includes attaching a screen assembly to a vibratory screening machine screening machine using a guide assembly to position the screen assembly in place and forming a top screening surface of the screen assembly into a concave shape. An operator may position the screen assembly into place by first pushing an edge of the frame of the screen assembly against a central member of the screening machine and then lowering the screen assembly into place using the guide assemblies to guide, locate and/or fix the screen assembly into a desired position so that the top screening surface may then be formed into a concave shape.

In the foregoing example embodiments are described. It will, however, be evident that various modifications and changes may be made thereunto without departing from the broader spirit and scope hereof. The specification and drawings are accordingly to be regarded in an illustrative rather than in a restrictive sense.

What is claimed is:

1. A screen assembly for a vibratory screening machine, comprising:

a frame; and a screen secured to the frame, wherein the screen assembly is configured to deform in to a predetermined concave shape when a first side of the screen assembly is subjected to a compression force applied by a compression assembly while a second side of the screen assembly is held in place against a wall member or a central member of the vibratory screening machine.

2. The screen assembly of claim 1, wherein the screen includes a screening surface that is at least one of flat and concave.

3. The screen assembly of claim 2, wherein the screening surface is at least one of flat and undulating.

4. A screen assembly for a vibratory screening machine, comprising:

a frame; and a screen supported by the frame, wherein the screen assembly is configured to form a predetermined concave shape when placed in the vibratory screening machine and a first side of the screen assembly is subjected to a compression force applied by a compression assembly while a second side of the screen assembly is held in place by being driven against a wall member or a central member of the vibratory screening machine.

5. The screen assembly of claim 4, wherein the predetermined concave shape is determined in accordance with a shape of a surface of the vibratory screening machine.

6. The screen assembly of claim 4, wherein the frame includes at least two flanges that have the shape of a tube or of a box.

7. The screen assembly of claim 4, wherein the screen includes at least two layers of woven mesh.

8. The screen assembly of claim 7, wherein the frame includes a semi-rigid perforated support plate.

9. A system, comprising: a screen assembly and a vibratory screening machine, wherein the vibratory screening machine includes a first wall member, a second wall member, a concave support surface located between the first and second wall members, and a compression assembly, wherein the screen assembly includes a frame and a screen attached to the frame, wherein the screen assembly forms a predetermined concave shape when the screen assembly is placed in the vibratory screening machine and a first side of the screen assembly is subjected to a compression force while a second side of the screen assembly is held in place, wherein the screen assembly is positioned above the concave support surface and between the first and second wall members, wherein the compression assembly drives the second side of the screen assembly into the second wall member and forms the screen assembly into the predetermined concave shape against the concave support surface.

10. The system of claim 9, wherein the compression assembly is attached to an exterior surface of the first wall member.

11. The system of claim 10, wherein the compression assembly includes a retractable member that advances and contracts, wherein as the retractable member advances it drives the screen assembly against the second wall member.

12. The system of claim 9, wherein the second wall member includes a stop surface that urges the screen assembly into the concave shape.

13. The system of claim 12, wherein the stop surface is angled relative to a vertical surface of the second wall whereby it secures the screen assembly in a fixed position when the compression assembly drives the screen assembly against the second wall member.

14. The system of claim 11, wherein the retractable member advances and contracts by at least one of a manual force, a hydraulic force and a pneumatic force.

15. The system of claim 9, further comprising a guide assembly attached to at least one of the first and second wall members, the guide assembly having a guide assembly mating surface and the screen assembly having a screen assembly mating surface that mates with the guide assembly mating surface.

16. The system of claim 15, wherein the guide assembly is configured to guide the screen assembly into a predetermined position.

17. The system of claim 15, wherein the guide assembly is removably attached.

18. The system of claim 15, wherein the guide assembly forms a part of the first or second wall member.

19. The system of claim 15, wherein the guide assembly includes a first guide assembly mating surface and a second guide assembly mating surface, the first mating surface interfacing with the screen assembly mating surface and the second guide assembly mating surface interfacing with another mating surface of another screen assembly.

20. The system of claim 15, wherein the guide assembly is formed as part of the vibratory screening machine.

21. The system of claim 9, wherein the screen assembly includes a screen assembly mating surface that interfaces with a guide assembly mating surface attached to the vibratory screening machine such that the screen assembly is guided into a fixed position above the concave support surface before the compression assembly drives the screen assembly into the second wall member.

22. The system of claim 15, wherein the screen assembly mating surface is a notch formed in a corner of the screen assembly.

23. The system of claim 15, wherein the screen assembly mating surface is a notch formed generally centrally in a side member of the screen assembly.

24. The screen assembly of claim 4, wherein the screen includes at least three layers of woven mesh.

25. The system of claim 9, wherein the screen includes at least three layers of woven mesh.

* * * * *